United States Patent [19]

Liautaud

[11] 4,179,698

[45] Dec. 18, 1979

[54] MOBILE ANTENNA WITH ADJUSTABLE RADIATING ELEMENT

[75] Inventor: James P. Liautaud, Cary, Ill.

[73] Assignee: American Antenna Corporation, Elgin, Ill.

[21] Appl. No.: 860,245

[22] Filed: Dec. 13, 1977

[51] Int. Cl.[2] ..... H01Q 1/32; H01Q 9/00; H01Q 1/50; H01Q 9/30

[52] U.S. Cl. ..... 343/715; 343/749; 343/850; 343/900

[58] Field of Search ..... 343/713, 715, 749, 745, 343/750, 850, 900

[56] References Cited

U.S. PATENT DOCUMENTS

| | | | |
|---|---|---|---|
| 2,808,278 | 9/1957 | Snyder | 343/900 |
| 3,145,384 | 1/1964 | Nuttle | 343/749 |
| 3,264,647 | 12/1965 | Nuttle | 343/900 |

*Primary Examiner*—Alfred E. Smith

*Assistant Examiner*—Harry E. Barlow

*Attorney, Agent, or Firm*—Lockwood, Dewey, Alex & Cummings

[57] ABSTRACT

A mobile antenna includes a radiating element which can be adjusted to an effective length to tune the antenna to a desired operating frequency without changing the physical length of the element. The radiating element is slidably received in a sleeve member positioned within a central bore having a tapered end of progressively decreasing diameter within the antenna base. The radiating element is locked in position by a deformable rim portion of increased diameter on the sleeve which is drawn into the tapered end of the bore and clamped around the radiating element by means of an axially-aligned bolt threaded into the opposite end of the sleeve. The bolt is preferably accessible only when the antenna is removed from its mounting base to discourage tampering with the antenna.

9 Claims, 7 Drawing Figures

FIG. 4
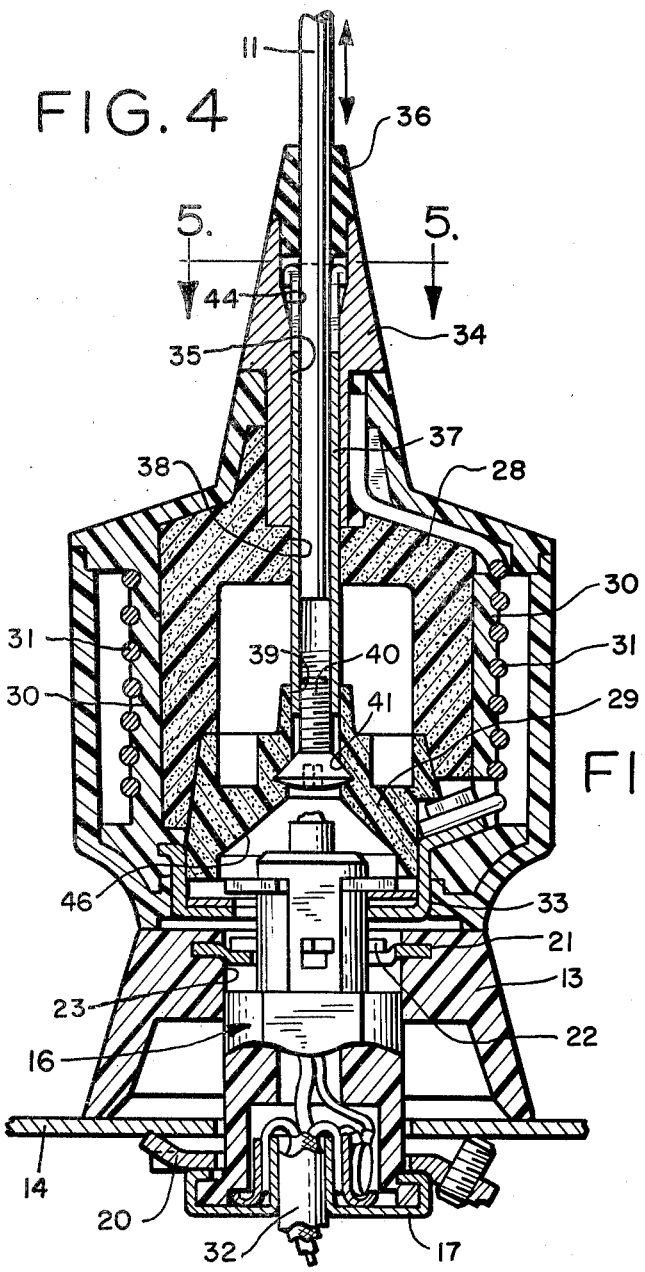
FIG. 6
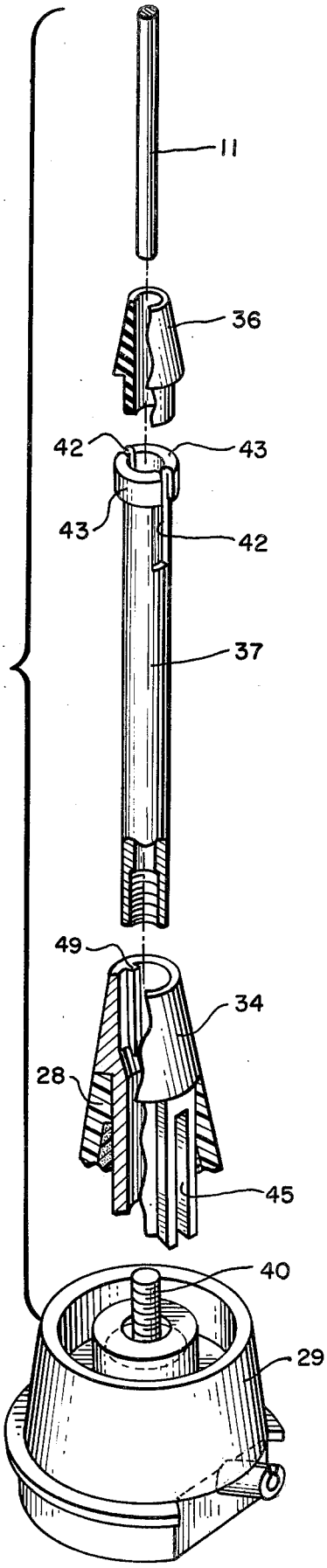
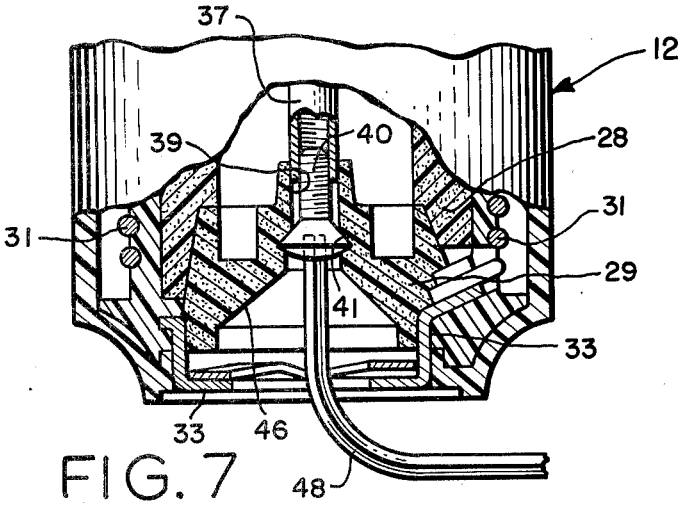
FIG. 7

MOBILE ANTENNA WITH ADJUSTABLE RADIATING ELEMENT

BACKGROUND OF THE INVENTION

The present invention relates generally to mobile antennas, and more particularly to a mobile antenna having a radiating element of adjustable effective length whereby the antenna can be tuned to a desired operating frequency without varying the physical length of the radiating element.

In recent years the increased use of personal mobile communications equipment, particularly that intended for use on the Citizens Band, has created a need for high-frequency antennas suitable for mounting on the exterior of automobiles or other vehicles. Such antennas are ordinarily required to operate within a desired range of transmitting frequencies, and the length of the radiating portion of such antennas is ordinarily made adjustable to enable the antenna to operate most efficiently in this range.

Where the length of the radiating portion has been adjustable in prior art mobile antennas, this has typically been accomplished by cutting the radiating element to length and then seating the element in a bore provided in an electrically conductive end fitting on the top of the base. The radiating element is then typically locked in the end fitting by means of a set screw in the end fitting perpendicular to the bore in which the radiating element is received. This arrangement has the disadvantage of requiring the user to cut the radiating element, which is not only time consuming, but also precludes the user from tuning the antenna to a lower operating frequency should that be required in the future as a result of a change in operating frequency or an error in his original length calculation. Furthermore, the exposed set screw utilized to lock the radiating element in position invites tampering with the antenna and the tuning adjustment.

Accordingly, the object of the present invention, generally stated, is to provide a new and improved mobile antenna in which the length of the radiating element can be adjusted without changing the physical length of the element.

Another object of the present invention is to provide a new and improved mobile antenna wherein the means for adjusting the length of the radiating element are inaccessible from the exterior of the antenna when the antenna is mounted for use.

SUMMARY OF THE INVENTION

The invention is directed to a mobile antenna of the type including a base adapted for releasable engagement with a vehicle-mounted base, and an elongated radiating element extending upwardly from the antenna base. The antenna base includes within a central bore an axially-aligned sleeve dimensioned to slidably receive the radiating element. The sleeve includes an inwardly deformable rim at one end which coacts with biasing means in the housing to decrease the girth of at least a portion of the sleeve about the radiating element so as to retain the radiating element in position.

BRIEF DESCRIPTION OF THE DRAWINGS

The features of the present invention, which are believed to be novel are set forth with particularity in the appended claims. The invention, together with the further objects and advantages thereof, may best be understood by reference to the following description taken in conjunction with the accompanying drawings, in the several figures of which like reference numerals identify like elements, and in which:

FIG. 4 is an enlarged cross-sectional view of the mobile antenna taken along line 4—4 of FIG. 1.

FIG. 6 is an enlarged exploded perspective view, partially cut away for clarity, of the radiating element and its mounting arrangement in the mobile antenna.

FIG. 7 is an elevational view, partially in section, of the user-adjustable locking arrangement for the radiating element of the antenna.

DESCRIPTION OF THE PREFERRED EMBODIMENT

Figure 1:
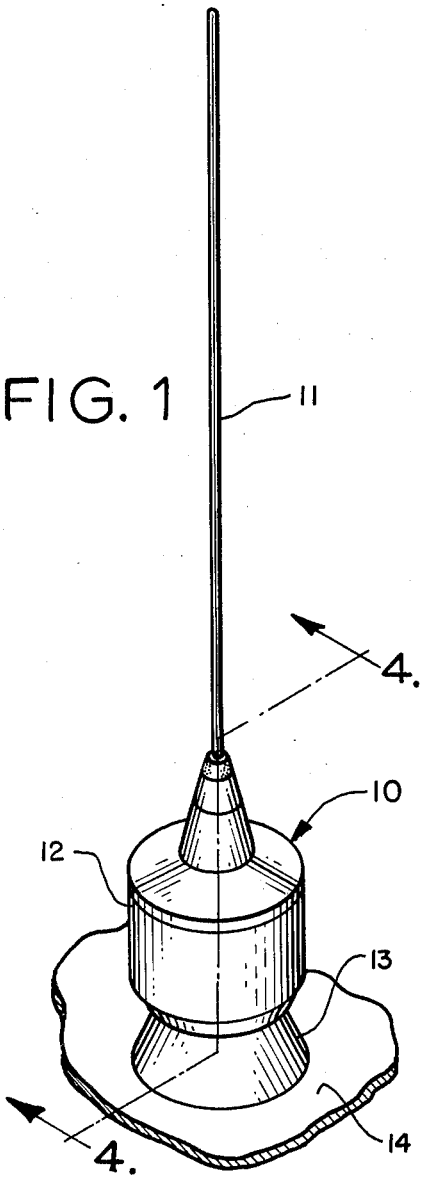
FIG. 1 is a perspective view of a mobile antenna incorporating a slidably adjustable radiating element in accordance with the invention.
Figure 2:
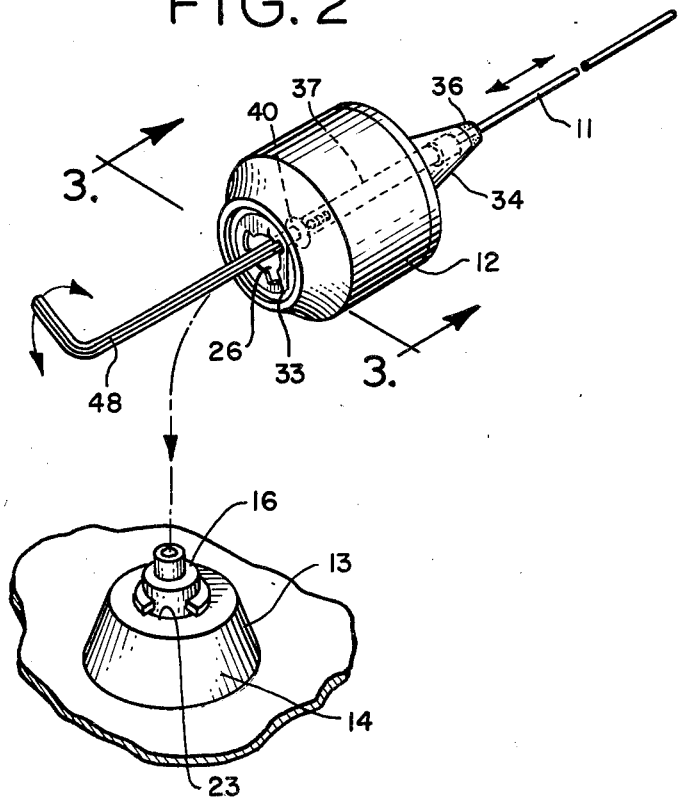
FIG. 2 is a perspective view of the antenna similar to FIG. 1 wherein the antenna has been removed from the antenna mounting base to facilitate adjustment of the radiating element.
Figure 5:
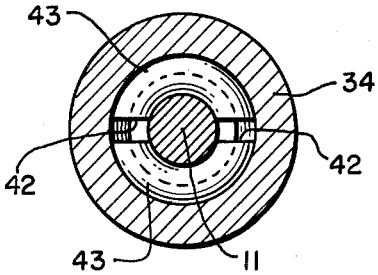
FIG. 5 is an enlarged cross-sectional view of the antenna of FIG. 4 taken along line 5—5 of FIG. 4.

Referring to the Figures, and particularly to FIGS. 1 and 2, a mobile antenna 10 constructed in accordance with the invention is seen to include a generally vertical radiating element 11 formed of a resilient electrically conductive wire or the like and an antenna base 12 from which the radiating element extends. The antenna base, which includes circuitry for effecting transfer of radio frequency signals between the radiating element and a coaxial cable, is removably mounted on a mounting skirt 13, which is in turn mounted on a supporting surface such as a body panel 14. Although the invention can be practiced in conjunction with various antenna constructions, reference is made to the co-pending applications of James P. Liautaud entitled "Mobile Antenna", Ser. No. 860,236, "Mobile Antenna Mounting Assembly", Ser. No. 860,237, "Mobile Antenna Including Quick Release Mounting", Ser. No. 860,247 and "Antenna Mounting Adaptor", Ser. No. 860,234, filed concurrently herewith, for detailed descriptions of preferred forms of antennas and antenna mounting arrangements. In each of these arrangements, the antenna base with radiating element attached is removable from the antenna mounting base, as shown in FIG. 2, so that the antenna can be stored when not in use to discourage theft and vandalism. The tip of radiating element 11 is preferably rounded as shown in FIG. 1.

Referring to FIG. 4, the antenna mounting base includes a bayonet mounting pin 16 having a generally cylindrical body terminated at its bottom end with flange 17 of increased diameter. When the mounting pin is inserted through an aperture in panel 14 as shown, flange 17 prevents the mounting pin from being pulled through the aperture. A retaining plate 20 is positioned between the flange and the underside of the plate to serve as a variable spacer whereby the antenna mounting skirt 13 can be drawn tightly against the top surface of the body panel.

The frusto-conical skirt 13 is releasably secured to the top of the bayonet mounting pin 16 by means of a central aperture 23 within which the mounting pin is slidably received. Means associated with this aperture including a locking plate 21 on the skirt, and locking tabs 22 on the mounting pin establish a twist-lock engagement between the pin and the mounting base. A second twist-lock connection is formed between the projecting end of mounting pin 16 and a socket 26 (FIG. 2) on the bottom surface of the antenna base 12. This connection locks the antenna base to the mounting pin, and hence to the mounting skirt 13 when the socket is inserted over the mounting pin and rotated.

The cylindrical body of antenna base 12 includes a hollow core formed of interlocking upper and lower core sections 28 and 29. A layer 30 of dielectric material is molded over the core to form a support layer for a helical antenna loading coil 31 which facilitates the transfer of radio frequency energy between the radiating element 11 and a coaxial cable 32. The bottom end of the coil is connected to a connector plate 33 which forms part of socket 26, and the top end of the coil is connected to an electrically-conductive end fitting 34 having a central axially-aligned bore 35. A bushing 36 may be fitted over the exposed end of fitting 34 to prevent foreign matter from entering the antenna base.

A hollow tubular sleeve 37 extends through bore 35 and into core sections 28 and 29 through respective axially-aligned bores 38 and 29 contained therein. Sleeve 37 is rendered user-adjustable along the antenna axis by means of a bolt 40 which includes a body portion in threaded engagement with the bottom end of sleeve 37 and a head portion captively contained within a complimentarily shaped recess 41 provided in core section 29. As the bolt is turned counter-clockwise the sleeve is forced to move upwardly along the antenna axis, and as the bolt is turned clockwise the sleeve is caused to move downwardly along the axis.

To provide a locking engagement for radiating element 11 the upper end of sleeve 37 is bifurcated by end slots 42 and folded back to form resilient semi-cylindrical rim portions 43 of increased diameter. These rim portions coact with a conical progressively narrowing tapered portion 44 of aperture 35 when sleeve 37 is drawn downwardly by bolt 40 with the result that the rim portions are caused to deform inwardly into binding engagement with radiating element 11. A key portion 49 of end fitting 34 prevents rotation of sleeve 37 as bolt 40 is turned.

The radiating element 11 is typically formed of stainless steel wire and the sleeve member 37 is typically formed of a thin resilient metal. Fitting 34 is preferably formed of a soft metal, and may include a channel 45 for receiving the top end of winding 31, which can be secured therein by staking or other appropriate means. The sealing member 36 is preferably formed of a synthetic rubber material and includes an external surface which provides an aesthetically pleasing appearance as an extension of the external surface of end fitting 34.

Figure 3:
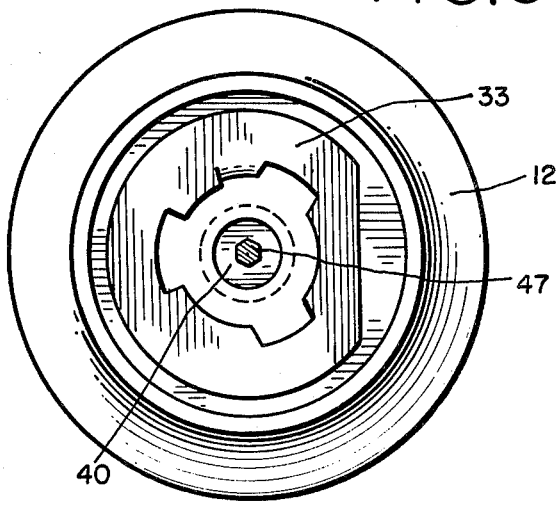
FIG. 3 is a bottom view of the antenna base of FIG. 2 taken along line 3—3 of FIG. 2.

Referring to FIG. 7 the bolt retaining recess 41 communicates with the aperture 46 which forms the hollow connector receiving portion of socket 26. The head of bolt 40, which in this embodiment includes a hex-shaped recess 47 (FIG. 3) for receiving the end of an allen wrench 48 (FIG. 2), is accessible through socket 26 when the antenna base is disengaged from the antenna skirt 13. As the bolt is rotated counter-clockwise, sleeve 37 is moved upwardly and the grasp of the bifurcated end portions 43 against element 11 is reduced to release the element for adjustment. As the bolt is rotated clockwise the sleeve is moved downwardly and the grasp of bifurcated end portions 43 against radiating element 11 is increased by ramp surface 44 and the element is locked in position. Preferably, the head of bolt 40 is coated with a lubricating substance when socket 26 is molded so as to allow the bolt to freely rotate in the aperture. During the molding process a hollow sleeve (not shown) may be temporarily positioned around the head of the bolt to prevent the bolt from being completely encapsulated.

In operation, radiating element 11 is slidably moved up and down in sleeve 37 until a preferred position is obtained, as indicated by an SWR meter or other appropriate means. The radiating element and antenna base are then disengaged from skirt member 13 and allen wrench 48 is inserted in socket 26 so that the end thereof engages aperture 46. Bolt 40 is then turned to draw sleeve 37 downwardly until the bifurcated end portions 43 are brought into locking engagement with radiating element 11. Next, the allen wrench is removed and the antenna base is remounted on skirt member 13 by positioning the interior of socket 26 over mounting pin 16 and rotating the antenna base until the components are locked together.

Thus, changes in the effective length of the radiating element are accomplished by positioning the non-radiating portion of the element within and on the axis of the loading coil. When the coil is formed with a relatively large diameter (large, compared to diameter of the radiating element) as in the illustrated embodiment, it has been found that the presence of the relatively narrow radiating element within the center of said coil has no measurable shunting effect on the electrical field of the coil. In one successful embodiment of the invention, a radiating element having a diameter of approximately 0.110" inch was utilized in conjunction with a coil of #12 gauge wire having an outside diameter of 2" inches and a length of two inches.

Because of its simple construction, the antenna of the present invention can be economically constructed by injection molding techniques. The use of the captivated bolt 40 in conjunction with sleeve 37 eliminates the need for sleeve bearings for receiving the radiating element in the housing, thereby further reducing the complexity and manufacturing cost of the antenna.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. A mobile antenna comprising, in combination:

an antenna base housing comprising walls defining a first opening means in said housing, the walls adjacent said opening means being inwardly converging;

an elongated radiating element extending into said first opening means;

a loading coil carried within said housing;

an elongated sleeve slidably carried within said housing and said first opening means and in conductive relationship with said coil, said sleeve comprising an enlarged outer end portion positioned between said converging walls and telescopically receiving said radiating element therewithin, the other end of said sleeve being disposed within said housing, inwardly of said outer end portion, locking means disposed within said housing and operable from the exterior thereof for cooperating with the inward end portion of said sleeve to draw said sleeve into said housing, whereby engagement between said converging walls and said enlarged end of said sleeve causes said sleeve to securely grip said radiating element, thereby locking said radiating element in position with respect to said housing.

2. A mobile antenna in accordance with claim 1 wherein said locking means include a portion rotatably mounted at a fixed axial position within said housing and in threaded engagement with said sleeve so that rotation of said locking means draws said sleeve into said housing.

3. A mobile antenna in accordance with claim 2 in which said portion of the locking means includes a screw, said housing having a cavity therein, said screw being captured within said cavity to prevent axial movement with respect to said housing.

4. A mobile antenna in accordance with claim 1 including a mounting base adapted to be secured to the surface of a vehicle, said walls of said housing defining a second opening means opposite to and in substantial axial alignment with said first opening means, said locking means being accessible only through said second opening means in said housing, and mounting means associated with said housing adjacent said second opening means to releasably mount said housing to said mounting base thereby closing said second opening means to the exterior when said antenna is mounted.

5. A mobile antenna in accordance with claim 4 wherein said coil is in axial alignment with said first and second opening means, said sleeve extends through said coil and is also in axial alignment with said first and second opening means, said locking means comprise a bolt in threaded engagement with the other end of said sleeve, said bolt including a head facing said second opening means for adjustment therethrough.

6. A mobile antenna in accordance with claim 5 wherein said coil is of substantially greater diameter than said radiating element, whereby the position of the radiating element within said sleeve may be varied to vary the operating frequency of said antenna without appreciably shunting the magnetic field of said coil.

7. A mobile antenna comprising, in combination:

a mounting base adapted to be secured to the surface of a vehicle, an antenna base assembly releasably securable to said mounting base, said assembly including:

a housing comprising walls defining a pair of opening means in said housing, the walls adjacent one of said opening means being inwardly converging;

an elongated radiating element extending into said one of said opening means, a loading coil carried within said housing, a sleeve slidably carried within said housing and in conductive relationship with said coil; said sleeve having an enlarged end portion positioned within said converging walls of said one opening means and telescopically receiving said radiating element therewithin, locking means at the other end of said sleeve for moving said sleeve into said housing, whereby engagement between said converging walls and said enlarged end of said sleeve causes said sleeve to securely grip said radiating element, said locking means being accessible only through said other opening means in said housing, and mounting means associated with said housing adjacent said other opening means to releasably mount said assembly to said mounting base, thereby closing said other opening means to the exterior.

8. A mobile antenna comprising:

an elongated radiating element, a base assembly including a housing for supporting said radiating element, said housing including opening means for slidably receiving the radiating element, one end of said element being received within said housing, the other end extending freely therefrom, a helical loading coil carried within said housing in a position so that said received end of said radiating element is received within and along the axis of said helical coil, means carried by said housing for electrically communicating between said radiating element and said coil, whereby the portion of said radiating element between said free end and said electrical communication means comprises the effective radiating length for said radiating element, and sliding of said radiating element into and out of said housing and in and along the axis of said coil selectively varies the effective radiating length, locking means in said housing for locking said slidable radiating element in a selected position, and wherein the diameter of said coil is substantially greater than the cross-sectional width of said radiating element so that said radiating element received within and along the axis of said coil does not appreciably shunt the magnetic field of the coil regardless of the length of said radiating element received therein.

9. A mobile antenna in accordance with claim 8 wherein said housing includes a sleeve axially aligned within said coil and in alignment with said opening means for slidably receiving and guiding said radiating element.

* * * * *